US005440964A

United States Patent [19]

Bender-Zanoni

[11] Patent Number: 5,440,964

[45] Date of Patent: Aug. 15, 1995

[54] AMMUNITION MAGAZINE DRIVE SYSTEM

[75] Inventor: Joseph F. Bender-Zanoni, Grand Isle, Vt.

[73] Assignee: Martin Marietta Corporation, King of Prussia, Pa.

[21] Appl. No.: 285,474

[22] Filed: Aug. 3, 1994

[51] Int. Cl.[6] ..... F41A 9/76

[52] U.S. Cl. ..... 89/34

[58] Field of Search ..... 89/33.1, 33.14, 33.16, 89/33.5, 34

[56] References Cited

U.S. PATENT DOCUMENTS 2,542,200 2/1951 Kraeger et al. ..... 89/34
3,370,506 2/1968 Altschuler et al. ..... 89/33.16
4,982,650 1/1991 Bender-Zanoni et al. ..... 89/34

*Primary Examiner*—Stephen C. Bentley
*Attorney, Agent, or Firm*—Geoffrey H. Krauss

[57] ABSTRACT

To distribute power to plural, widely spaced driven sprocket sets of an ammunition magazine chain conveyor, one or more elongated drive shafts, driven by a prime mover, are journalled in closely spaced relation to a magazine sidewall and carry worms in axial positions to mesh with worm gears fixed on the sprocket shafts of the driven sprocket sets. The axial positions of the worms on the drive shafts are conveniently adjustable to coordinate the timings of the driven sprocket sets. One of the driven sprocket sets is also positionally adjustable to tension adjust the ammunition chain conveyor.

11 Claims, 3 Drawing Sheets

AMMUNITION MAGAZINE DRIVE SYSTEM

BACKGROUND OF THE INVENTION

1. Field of the Invention

The present invention relates to ammunition handling systems and particularly to an improved drive system for powering ammunition magazine conveyors.

2. Description of the Related Prior Art

Ammunition magazines serving rapid-fire guns typically include a conveyor for circulating rounds of ammunition throughout the magazine interior enroute to an outlet port from which the ammunition rounds are serially delivered to the gun for firing. The magazine conveyor is typically in the form of an endless chain conveyor trained around a plurality of distributed, turnaround sprocket sets in a serpentine path to maximize magazine storage capacity. The ammunition rounds are confined in a succession of carriers connected to the chain conveyor at regular intervals. Propulsion of the magazine conveyor often requires that the conveyor drive system distribute power to plural turnaround sprocket sets located at appropriate intervals along the conveyor run between one or more idler turnaround sprocket sets. For high capacity ammunition magazines, the spacings between driven sprocket sets can be large.

In the case of large caliber ammunition magazines, the ammunition feed rate is relatively low, and thus the sprocket sets may rotate at rather low speeds of, for example, 1 to 10 rpm. However, high performance conveyor prime movers typically operate at substantially higher speeds of, for example, 2000 to 6000 rpm. Consequently, a very large speed reduction must be introduced into the conveyor drive system between the prime mover or motor and the driven sprocket sets.

A typical practice is to introduce the requisite large speed reduction immediately at the output of the conveyor prime mover. Consequently, the power is distributed to the driven sprocket sets from the output of the speed reducer, typically a high reduction gear box, at a relatively slow speed with accompanying high torque. To handle this torque, the drive train components must be physically robust, thus adding size, weight and cost to the magazine design.

An alternative approach is to distribute power to the drive sprocket sets at high speed and low torque, and then introduce the requisite speed reductions at the sites of each of the driven sprocket sets. This approach typically involves implementation of drive trains including separate spur gear reduction boxes drivingly connected to each of the driven sprockets, which, in turn, are driven off the prime mover via interconnecting chains or belts. Such drive trains are difficult to package in an efficient ammunition magazine design and represent a significant expense.

SUMMARY OF THE INVENTION

It is accordingly an objective of the present invention to provide an improved drive system for ammunition magazines that overcomes the drawbacks and disadvantages of the prior art noted above.

To this end, the present invention provides an ammunition magazine comprising a magazine housing, a plurality of sprocket sets mounted in distributed relation throughout the interior of the magazine housing with at least two of the plural sprocket sets being driven. Each sprocket set includes a pair of spaced sprockets mounted on a Sprocket shaft, and an ammunition chain conveyor is trained around the plural sprocket sets in driving engagement.

A separate worm gear is drivingly mounted on the sprocket shaft of each Of the two driven sprocket sets, and an elongated main drive shaft, driven by a prime mover, extends between the two driven sprocket sets. A pair of worm gears are drivingly mounted on the drive shaft in axial positions to respectively mesh with the worm gears, such that power is distributed to the driven sprocket sets from the prime mover at a reduced speed to propel the ammunition throughout the housing interior at a desired ammunition feed rate.

In accordance with a feature of the invention, the axial positions of the worms on the drive shaft are conveniently adjustable to readily set the timings or angular relationships between the driven sprocket sets to establish proper driving engagements with the ammunition chain conveyor. Also, at least one of the driven sprocket sets is mounted for positional adjustment in concert with axial position adjustment of the associated worm on the main drive shaft to establish requisite tensioning of the ammunition chain conveyor.

Power distribution to any additional sprocket sets located at positions in non-axial alignment with the main drive shaft is achieved using one or more angularly offset extension drive shafts drivingly connected to the main drive shaft via appropriate drive couplings. The extension drive shaft carries a worm for meshing engagement with a worm gear drivingly connected to the sprocket shaft of the additional driven sprocket set.

Additional features and advantages of the invention will be set forth in the description which follows, and in part will be apparent from the description, or may be learned by practice of the invention. The objectives and other advantages of the invention will be realized and attained by the drive system particularly pointed out in the written description and claims hereof, as well as in the appended drawings.

It is to be understood that both the foregoing general description and the following detailed description are exemplary and explanatory and intended to provide further explanation of the invention as claimed.

The accompanying drawings are included to provide a fuller understanding of the invention, are incorporated in and constituted a part of this specification to illustrate a preferred embodiment of the invention, and, together with the description, served to explain the principles of the invention.

BRIEF DESCRIPTION OF THE DRAWINGS

Like reference numerals refer to corresponding parts throughout the several views of the drawings.

DETAILED DESCRIPTION OF THE PREFERRED EMBODIMENT

Figure 1:
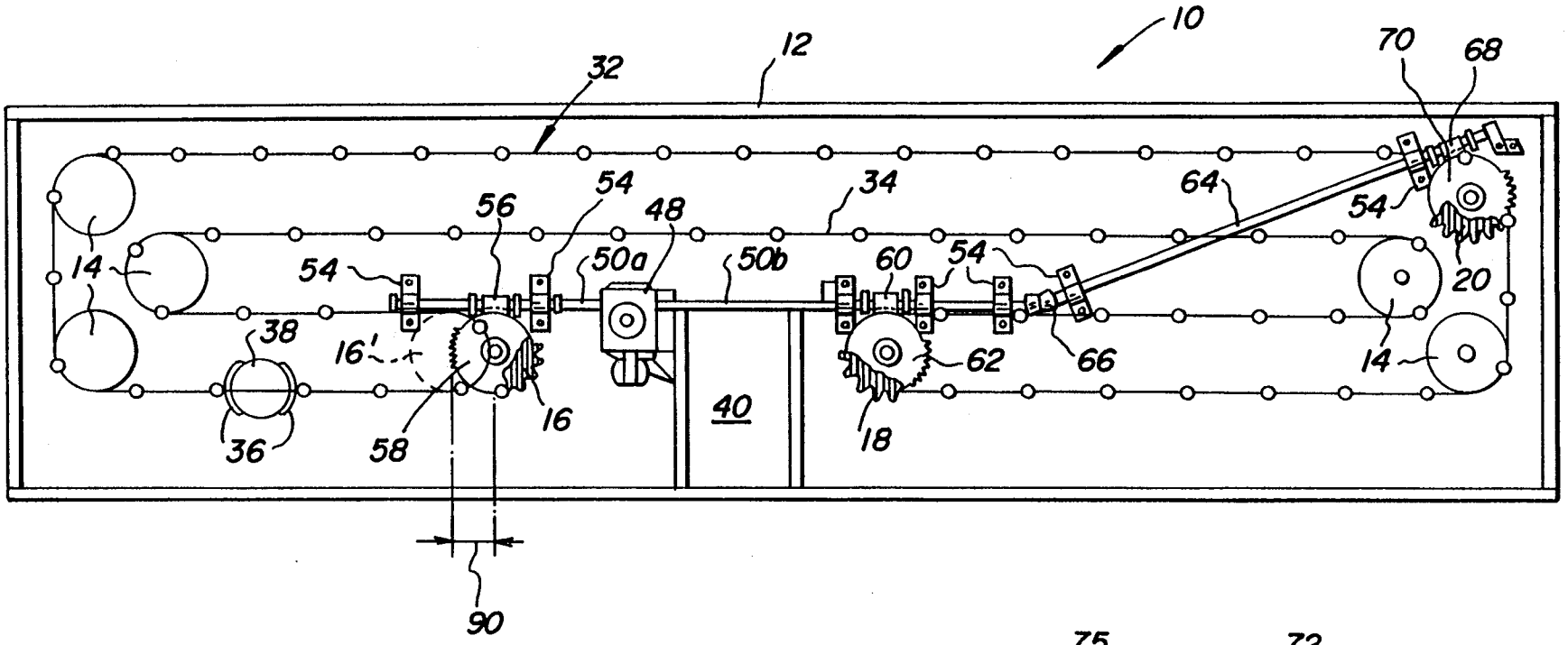
FIG. 1 is a side view of an ammunition magazine, partially broken away, incorporating a drive system in accordance with the present invention.
Figure 2:
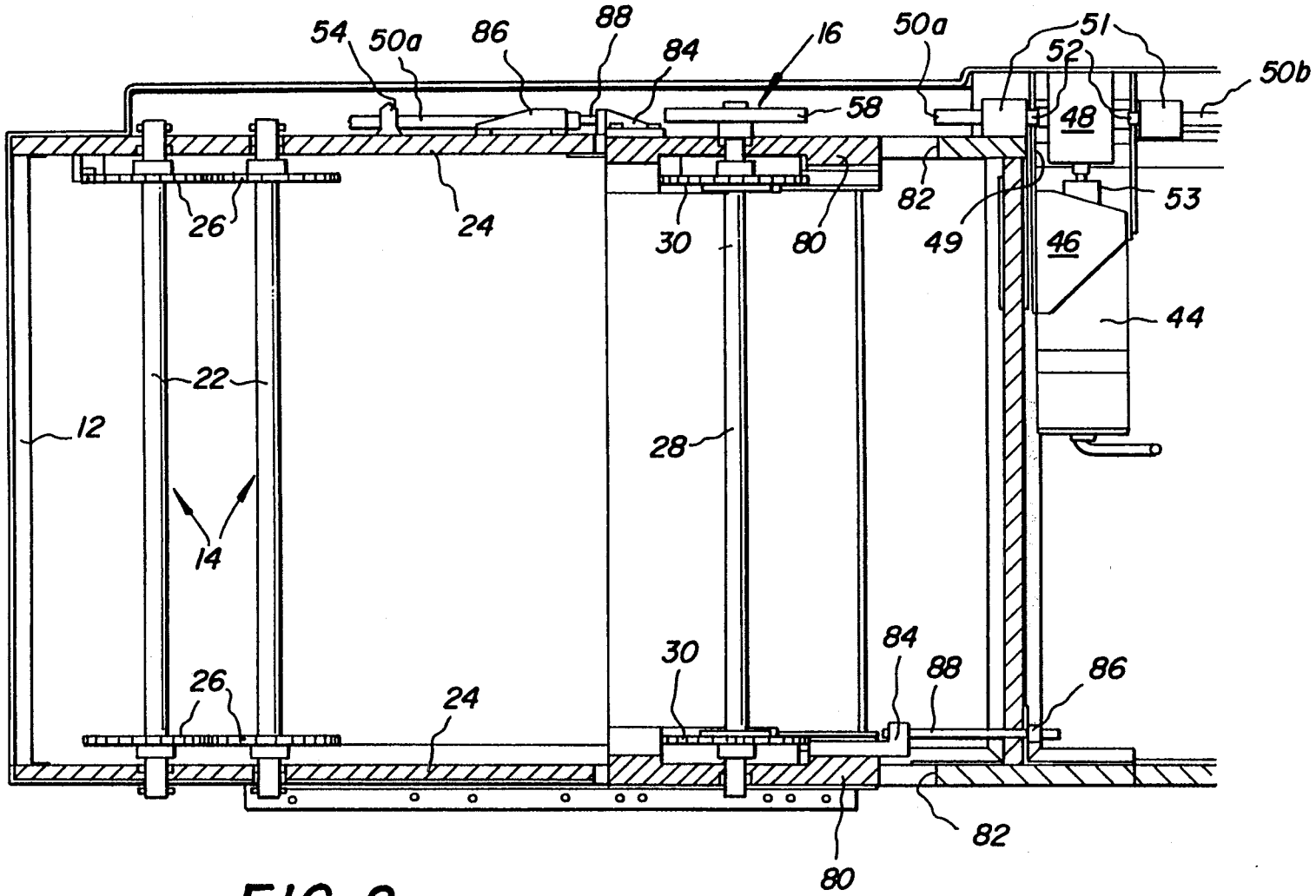
FIG. 2 is an enlarged plan view of a portion of the ammunition magazine seen in FIG. 1.

The ammunition magazine of the present invention, generally indicated at 10, includes, as seen in FIG. 1, a housing 12 for mounting a plurality of idler, turnaround sprocket sets 14 and a plurality of driven, turnaround sprocket sets, three in the illustrated embodiment indicated at 16, 18, and 20. As seen in FIG. 2, each idler sprocket set 14 includes a shaft 22 journalled adjacent its ends by opposed housing side walls 24 and mounting an idler sprocket 26 at corresponding axially spaced positions approximate the inner sides of the housing sidewalls. Each driven sprocket set includes, as exemplified by sprocket set 16 illustrated in FIG. 2, a shaft 28 journalled adjacent its ends by the housing sidewalls 24 and mounting sprockets 30 at axial positions approximate the inner sides of the housing sidewalls.

Trained around the sprockets of the idler and driven sprocket sets is an endless chain conveyor, generally indicated at 32 in FIG. 1. This chain conveyor includes laterally spaced, parallel chains, collectively indicated at 34, that respectively engaging the sprockets of the idler and driven sprocket sets correspondingly laterally spaced on their respective sprocket shafts. Articulated carriers of conventional construction, one indicated at 36, are connected between the conveyor chains 34 at corresponding, laterally aligned chain link points to securely hold ammunition rounds, one indicated at 38, during conveyance. The idler and driven sprockets sets are relatively positioned within the magazine housing 12 at appropriate turnaround locations to establish a serpentine conveyor path, consistent with maximizing magazine storage capacity. During conveyance, the ammunition rounds arrived at an outlet port, schematically indicated at 40 in FIG. 1, where they are handed off for serial delivery to a rapid fire gun (not shown).

Referring jointly to FIGS. 1 and 2, a prime mover 44, such as a high efficiency, high speed electrical motor, is mounted internally of housing 12 by a bracket 46 and drives a right angle gear box 48 mounted in a housing sidewall opening 49 (FIG. 2). The gear box drives a main drive shaft comprised of drive shaft segments **50*a* and 50*b*, as best seen in FIG. 1, which are connected at their opposed ends by couplings 51 to gearbox output stub shafts 52 oriented orthogonally to the motor output shaft 53, as seen in FIG. 2. For some applications, it may be desirable that gear box 48** provide a slight speed reduction, for example 5:1.

As best seen in FIG. 1, the drive shaft segments **50*a* and 50*b* are journalled to the exterior side of the front housing sidewall 24 in axially aligned relation by pillow bearings 54. Keyed to drive shaft segment 50*a* is a worm 56 at an axial position to mesh with a worm gear 58 fixed to the end of sprocket shaft 28 of driven sprocket set 16, that extends outwardly beyond the housing sidewall. Similarly, a worm 60 is keyed to drive shaft segment 50*b* at an appropriate axial position to mesh with a worm gear 62 fixed to the end of the sprocket shaft of driven sprocket set 18**, that also extends outwardly beyond the housing sidewall.

From the foregoing description, it is seen that sprocket sets 16 and 18 are driven at a common reduced speed determined by identical gear ratios of worm 56-worm gear 58 and worm 60-worm gear 62. Power distribution to these driven sprocket sets is smooth and with minimal backlash. It will be appreciated that the drive train including the drive shaft segments **50*a*, 50*b* and the worm gear sets 56, 58 and 60, 62 can be packaged in a space-saving and efficient manner in close proximity along a side of housing sidewall 24**. Moreover, since power is distributed at high speed and low torque to driven sprocket sets that may be spaced many feet apart, the high speed components of the drive train may be of a low cost, compact design.

Typical large caliber, high capacity ammunition designs require the conveyor drive train to distribute power to additional sprocket sets of an ammunition conveyor. By virtue of the adaptability and flexibility of the present invention, this requirement can be readily met. As seen in FIG. 1, a drive shaft extension 64, also mounted to the housing Side wall by pillow bearings 54, is drivingly connected at one end to the free end of main drive shaft segment **50*b* in non-axially aligned relation by a double universal joint 66. A worm 68 is keyed to this drive shaft extension adjacent its other end in axial position to mesh with a worm gear 70 fixed on the sprocket shaft of sprocket set 20. Thus, this additional sprocket set is driven at the same reduced speed as driven sprocket sets 16 and 18**. It will be appreciated that, depending upon the particular magazine design, other main drive shaft couplings, such as a one-to-one, right angle gear boxes, may be used to extend drive train power distribution to additional conveyor sprocket sets.

Figure 4:
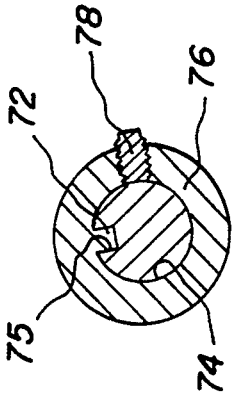
FIG. 4 is a sectional view taken along line 4—4 in FIG. 3.
Figure 3:
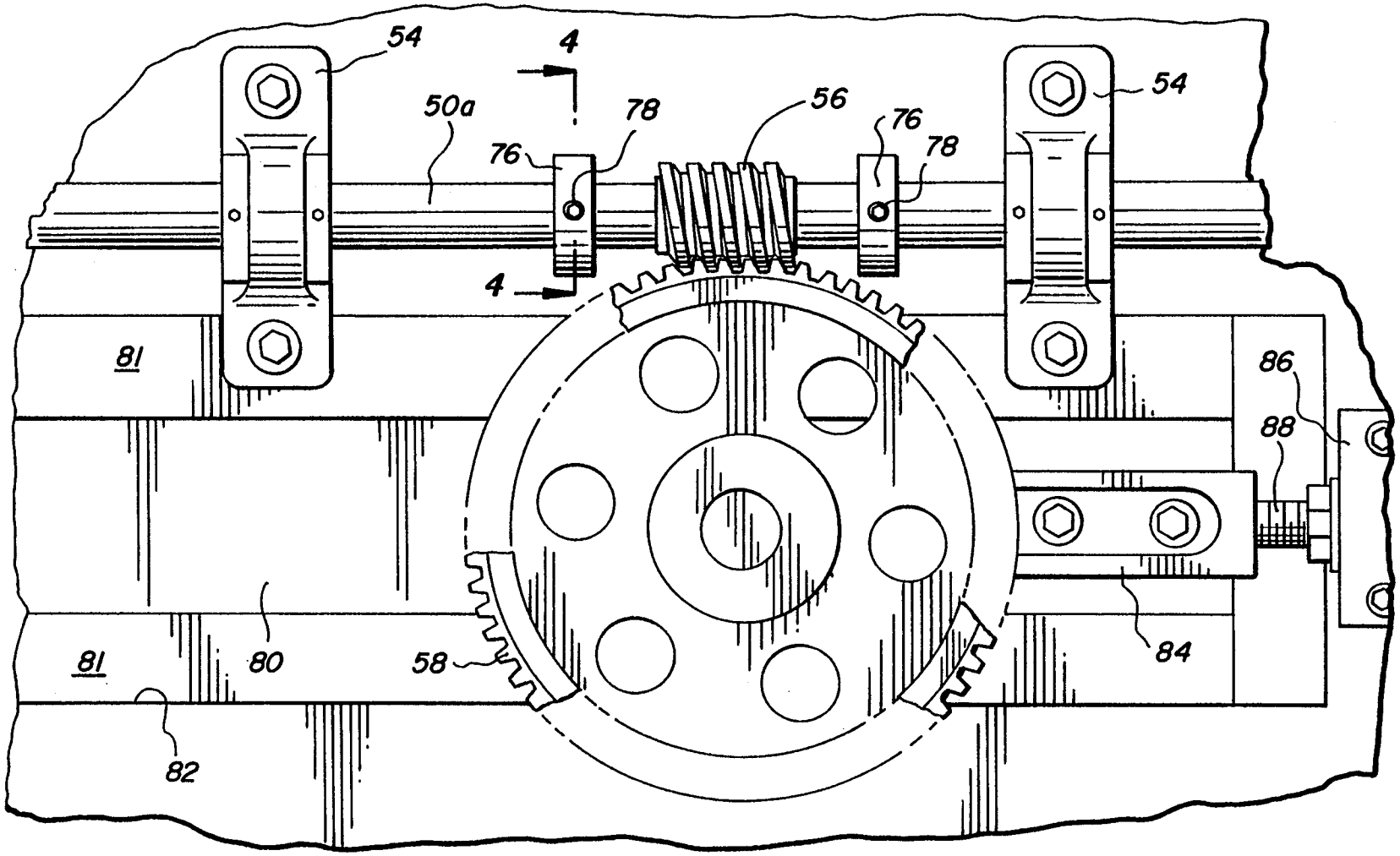
FIG. 3 is an enlarged fragmentary side view of the ammunition magazine of FIG. 1.

To accommodate convenient timing adjustments of the driven sprocket sets, sprocket sets 16, 18 and 20 in the illustrated embodiment, provisions for adjusting the shaft axial positions of the worms are provided in accordance with a feature of the present invention. As illustrated in FIGS. 3 and 4 in the case of driven sprocket set 16, each worm gear is slidably mounted on its drive shaft with a tang 72 projecting inwardly from bore 74 being received in a full length, longitudinal keying groove 74 machined in the drive shaft surface. Collars 76, formed at opposed ends of each worm, are radially tapped to received set screws 78 for fixing the axial positions of the worms on their shafts. By retracting the set screws and shifting the axial positions of the worms in coordination, the angular positions of the meshing worm gears and the drivingly connecting sprocket sets can be adjusted to achieve proper engagements of the driven sprocket sets with chains 34 of ammunition conveyor 32. Once this requisite timing is achieved, the set screws are turned down into clamping engagement with the drive shafts to fix the operating axial positions of the worms. Other keying provisions that permit axial position adjustments of the worms and rotation driving engagement with their mounting shafts will readily occur to those skilled in the mechanical art.

Referring jointly to FIGS. 2 and 3, one of the driven sprocket sets, sprocket set 16 in the illustrated embodiment, is journalled by a pair of opposed blocks 80 respectively, slidingly mounted by upper and lower longitudinal guides 81 fixed in laterally aligned openings 82 in housing sidewalls 24. Affixed to each block 80 is a bracket 84 in longitudinally opposed relation to a housing-mounted bracket 86. The opposed brackets of each pair are threadedly engaged by an elongated screw 88. It is seen that coordinated turnings of screws 88 shift the longitudinal position of driven sprocket set 16 to adjustably set an appropriate tension for ammunition convey or 32. The range of tension adjustment is illustrated at 90, where sprocket set 16 may be shifted longitudinally between the solid line position and a phantom line position indicated at 16' in FIG. 1.

While the present invention has been described in terms of its application to large caliber ammunition magazines calling for low conveyor speeds requiring overall speed reductions of, for example, 400:1, it will be appreciated that the flexibility and low cost, compact design features of the present invention may be utilized in high speed ammunition magazine conveyors by appropriate design of the worm gear sets at the various driven sprocket sets. That is, by not using a speed reduction gear box 48 and using low ratio worm gear sets, overall speed reductions of, for example, 4:1, can be implemented to drive ammunition conveyor 32 at high speed. It will be appreciated that the present invention is conducive to distributing power to plural, widely spaced sprocket sets to drive an ammunition conveyor at a virtually infinite number of speeds depending upon the gear ratios of the worm gear sets and gear box 48. Of course, if motor 44 can be packaged with its output shaft axially aligned with the main drive shaft of the drive train, a gear box at the motor output would be unnecessary when an initial speed reduction is not required. While the embodiment of the invention illustrated in FIG. 1 utilizes a main drive shaft to distribute power to a pair of sprocket sets 16 and 18 and extension drive shaft 64 to extend power distribution to a third sprocket set 20, it will be appreciated that the drive train can assume a variety of configurations. For example, if sprocket set 18 need not be a driven sprocket set, power is then distributed to sprocket set 16 via main drive shaft segment 50*a* and to sprocket set 20 via main drive shaft segment 50*b* and extension drive shaft 64.

It will be apparent to those skilled in the art that various modifications and variations can be made in the ammunition magazine drive system of the present invention without departing from the spirit or scope of the invention. Thus it is intended the present invention cover the modifications and variations of this invention provided they come within the scope of the appended claims and their equivalents.

What is claimed is:

1. An ammunition magazine comprising:

a housing;

a plurality of idler sprocket sets mounted in distributed relation within the housing;

at least first and second driven sprocket sets mounted in spaced relation within the housing, the first and second driven sprocket sets including respective first and second sprocket shafts;

an ammunition chain conveyor trained around the idler and driven sprocket sets;

first and second worm gears respectively drivingly connected to the first and second sprocket shafts;

drive shaft means extending between the first and second worm gears;

a prime mover coupled to drivingly rotate the drive shaft means;

first and second worms drivingly mounted on the drive shaft means in axial positions to respectively mesh with the first and second worm gears; and means accommodating adjustment of the axial position of at least the first worm on the drive shaft means.

2. The ammunition magazine defined in claim 1, wherein the adjustment means includes keying means formed on the drive shaft means and the first worm to prevent relative rotation while accommodating adjustment of the axial position of the first worm on the main drive shaft means.

3. The ammunition magazine defined in claim 1, further including means accommodating adjustment of the axial position of the first worm on the drive shaft means and positional adjustment of the first driven sprocket set.

4. The ammunition magazine defined in claim 3, wherein the adjustment means includes a pair of blocks slidingly mounted by the housing in opposed relation for rotatably mounting the first drive sprocket shaft, a separate first bracket mounted by each of the blocks, a separate second bracket mounted by the housing in opposed relation with each first bracket, and a separate screw shaft threadedly engaging each pair of opposed first and second brackets.

5. The ammunition magazine defined in claim 4, wherein the adjustment means further includes interlocking keying provisions provided on the drive shaft means and the first worm to prevent relative rotation while accommodating sliding positional adjustment of the first worm on the drive shaft means and set screws for clamping the first worm to the drive shaft means to fix the axial position of the first worm.

6. The ammunition magazine recited in claim 1, further comprising:

a third driven sprocket set drivingly engaging the ammunition chain conveyor and including a third sprocket shaft;

a third worm gear drivingly connected to the third sprocket shaft;

the drive shaft means including a main drive shaft and an extension drive shaft rotatably mounted in non-axially aligned relation with the main drive shaft, the first and second worms drivingly mounted on the main drive shaft;

a coupling drivingly interconnecting the main and extension drive shafts; and a third worm drivingly mounted on the extension drive shaft in an axial position to mesh with the third worm gear.

7. The ammunition magazine defined in claim 6, wherein the coupling is a double universal joint.

8. The ammunition conveyor defined in claim 7, wherein the adjustment means accommodates adjustments of the axial positions of the first, second and third worms on the main and extension drive shafts.

9. The ammunition conveyor defined in claim 8, further including bearings rotatably mounting the main and extension drive shafts in closely spaced relation to a sidewall of the housing.

10. An ammunition magazine comprising:

a housing;

a plurality of idler sprocket sets mounted in distributed relation within the housing;

at least first and second driven sprocket sets mounted in spaced relation within the housing, the first and second driven sprocket sets including respective first and second sprocket shafts;

an ammunition chain conveyor trained around the idler and driven sprocket sets;

first and second worm gears respectively drivingly connected to the first and second sprocket shafts;

a main drive shaft;

an extension drive shaft rotatably mounted in non-axially aligned relation with the main drive shaft;

a coupling drivingly interconnecting the main and extension drive shafts;

a prime mover coupled to drivingly rotate the main and extension drive shafts in unison;

a first worm drivingly mounted on the main drive shaft in an axial position to mesh with the first worm gear; and a second worm drivingly mounted on the extension drive shaft in an axial position to mesh with the second worm gear.

11. The ammunition magazine defined in claim 10, further including means accommodating axial drive shaft position adjustment of at least one of the first and second worms.

* * * * *